US006336859B2

(12) United States Patent
Jones et al.

(10) Patent No.: US 6,336,859 B2
(45) **Date of Patent: *Jan. 8, 2002**

(54) METHOD FOR PROGRESSIVE JACKPOT GAMING

(75) Inventors: Daniel A. Jones; James P. Suttle, both of Las Vegas, NV (US)

(73) Assignee: Progressive Games, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/844,154

(22) Filed: Apr. 27, 2001

Related U.S. Application Data

(60) Continuation of application No. 09/583,109, filed on May 24, 2000, now Pat. No. 6,234,895, which is a continuation of application No. 09/436,772, filed on Nov. 5, 1999, which is a continuation of application No. 09/266,613, filed on Mar. 9, 1999, now Pat. No. 6,045,130, which is a continuation of application No. 08/967,850, filed on Nov. 12, 1997, now Pat. No. 5,913,726, which is a continuation of application No. 08/811,364, filed on Mar. 6, 1997, now Pat. No. 5,795,225, which is a continuation of application No. 08/334,661, filed on Nov. 4, 1994, now Pat. No. 5,584,788, which is a division of application No. 08/040,925, filed on Mar. 31, 1993, now Pat. No. 5,364,104.

(51) Int. Cl.[7] ..... A63F 1/00

(52) U.S. Cl. ..... 463/13; 463/12; 463/25; 463/27; 273/309; 273/292; 273/274

(58) Field of Search ..... 273/292, 274, 273/309, 143 R; 463/12, 13, 20, 26–28

(56) References Cited

U.S. PATENT DOCUMENTS

| | | |
|---|---|---|
| 1,238,736 A | 9/1917 | Barrett |
| 1,527,929 A | 2/1925 | Simons |

(List continued on next page.)

FOREIGN PATENT DOCUMENTS

| | | |
|---|---|---|
| AT | 96049 | 4/1988 |
| AU | 621599 | 4/1989 |

(List continued on next page.)

OTHER PUBLICATIONS

Three–In–One, Scarne's Encyclopedia of Games, John Scarne, Harper & Row Publishers, p. 381, 1973.*

(List continued on next page.)

*Primary Examiner*—Benjamin H. Layno

(57) ABSTRACT

The method of the present invention generally involves a typical casino or cardroom game modified to include a progressive jackpot component. During the play of a Twenty-One game, for example, in addition to this normal wager, a player will have the option of making an additional wager that becomes part of, and makes the player eligible to win, the progressive jackpot. If the player's Twenty-One hand comprises a particular, predetermined arrangement of cards, the player will win all, or part of, the amount showing on the progressive jackpot. This progressive jackpot feature is also adaptable to any other casino or cardroom game such as Draw Poker, Stud Poker, Lo-Ball Poker or Caribbean Stud™ Poker. The apparatus used to practice the present invention comprises a gaming table, such as those used for Twenty-One or poker, modified with the addition of a coin acceptor that is electronically connected to a progressive jackpot meter. When player drops a coin into the coin acceptor, a light is activated at the player's location indicating that he is participating in the progressive jackpot component of the game during that hand. AT the same time, a signal from the coin acceptor is sent to the progressive meter to increment the amount shown on the progressive meter. At the conclusion of the play of each hand, the coin acceptor is reset for the next hand. When a player wins all or part of the progressive jackpot, the amount showing on the progressive jackpot meter is reduced by the amount won by the player. Any number of gaming tables can be connected to a single progressive jackpot meter.

88 Claims, 4 Drawing Sheets

U.S. PATENT DOCUMENTS 1,763,476 A 6/1930 Morris
1,970,876 A 8/1934 Anderson
2,008,829 A 7/1935 Israel
D105,610 S 8/1937 Posey
D118,451 S 1/1940 Radford
2,199,745 A 5/1940 Harris
D183,007 S 6/1958 Lord
3,011,789 A 12/1961 Eliassen et al.
3,269,503 A 8/1966 Foster
D213,891 S 4/1969 Schultz
3,556,531 A 1/1971 Elder
D220,635 S 5/1971 Boyer et al.
3,663,021 A 5/1972 Whippo
3,667,757 A 6/1972 Holmberg
3,689,071 A 9/1972 Kucera
3,796,433 A 3/1974 Fraley et al.
3,825,255 A 7/1974 Kennard et al.
3,874,671 A 4/1975 Smith
3,876,208 A 4/1975 Wachtler et al.
3,998,462 A 12/1976 Goott
D245,717 S 9/1977 Jessie
4,063,680 A 12/1977 Leo
4,099,722 A 7/1978 Rodesch et al.
4,232,866 A 11/1980 Pennachio
4,302,012 A 11/1981 Di Giovanni et al.
4,305,586 A 12/1981 Richards
4,312,508 A 1/1982 Wood
D263,975 S 4/1982 Quisuga et al.
4,364,567 A 12/1982 Goott
4,397,469 A 8/1983 Carter, III
4,518,001 A 5/1985 Branham
4,531,187 A 7/1985 Uhland
4,569,526 A 2/1986 Hamilton
4,575,085 A 3/1986 Ollington
4,614,342 A 9/1986 Takashima
4,624,459 A 11/1986 Kaufman
4,648,604 A 3/1987 Horan
4,651,997 A 3/1987 Wood
4,666,160 A 5/1987 Hamilton
4,700,948 A 10/1987 Okada
4,721,307 A 1/1988 Okada
4,743,022 A 5/1988 Wood
4,756,531 A 7/1988 DiRe et al.
4,759,549 A 7/1988 Beckwith
4,760,527 A 7/1988 Sidley
4,813,675 A 3/1989 Greenwood
4,836,546 A 6/1989 DiRe et al.
4,836,553 A 6/1989 Suttle et al.
4,837,728 A * 6/1989 Barrie et al. ..... 273/143 R
4,861,041 A * 8/1989 Jones et al. ..... 273/292.2
4,926,327 A 5/1990 Sidley
4,948,134 A 8/1990 Suttle et al.
D311,474 S 10/1990 Hoffman
4,964,638 A 10/1990 Ishida
5,007,519 A 4/1991 Mercurio
5,019,973 A 5/1991 Wilcox et al.
5,022,653 A 6/1991 Suttle et al.
5,042,818 A 8/1991 Weingardt
5,078,405 A 1/1992 Jones et al.
5,092,598 A 3/1992 Kamille
5,098,107 A 3/1992 Boylan et al.
5,100,137 A 3/1992 Fulton
5,106,089 A 4/1992 Wood
5,112,060 A 5/1992 Jones
5,154,429 A 10/1992 Le Vasseur
5,167,413 A 12/1992 Fulton
5,248,142 A 9/1993 Breeding
5,249,800 A 10/1993 Hilgendorf et al.
5,251,897 A 10/1993 Fulton
5,255,915 A 10/1993 Miller
5,257,784 A 11/1993 Boylan et al.
5,257,810 A 11/1993 Schorr et al.
5,265,877 A 11/1993 Boylan et al.
5,275,400 A 1/1994 Weingardt et al.
5,275,411 A 1/1994 Breeding
5,275,415 A 1/1994 Wisted
5,277,424 A 1/1994 Wilms
5,286,023 A 2/1994 Wood
5,288,077 A 2/1994 Jones
5,288,081 A 2/1994 Breeding
5,294,128 A 3/1994 Marquez
5,322,295 A 6/1994 Cabot et al.
5,364,104 A 11/1994 Jones et al.
5,364,105 A 11/1994 Jones
5,374,067 A 12/1994 Jones
5,377,973 A 1/1995 Jones
5,377,994 A 1/1995 Jones
5,380,012 A 1/1995 Jones et al.
5,382,025 A 1/1995 Sklansky et al.
5,390,934 A 2/1995 Grassa
5,393,067 A 2/1995 Paulsen et al.
5,401,023 A 3/1995 Wood
5,411,257 A 5/1995 Fulton
5,417,430 A 5/1995 Breeding
5,437,462 A 8/1995 Breeding
5,445,391 A 8/1995 Gleason, Jr.
5,472,194 A 12/1995 Breeding et al.
5,489,101 A 2/1996 Moody
5,495,296 A 2/1996 Grassa
5,511,781 A 4/1996 Wood et al.
5,531,448 A 7/1996 Moody
5,536,016 A 7/1996 Thompson
5,573,245 A 11/1996 Weiner et al.
5,577,731 A 11/1996 Jones
5,584,485 A 12/1996 Jones et al.
5,597,162 A 1/1997 Franklin
5,605,504 A 2/1997 Huang
5,626,341 A 5/1997 Jones et al.
5,636,843 A 6/1997 Roberts
5,664,781 A 9/1997 Feola
5,695,402 A 12/1997 Stupak
5,713,573 A 2/1998 Nazaryan
5,718,631 A 2/1998 Invencion
5,725,216 A 3/1998 Jones
5,732,950 A 3/1998 Moody
5,743,798 A 4/1998 Adams et al.
5,755,621 A 5/1998 Marks et al.
5,770,533 A 6/1998 Franchi
5,772,211 A 6/1998 Nazaryan et al.
5,775,992 A 7/1998 Wood et al.
5,785,593 A 7/1998 Wood et al.
5,788,241 A 8/1998 Ung
5,794,964 A 8/1998 Jones et al.
5,795,225 A 8/1998 Jones et al.
5,803,809 A 9/1998 Yoseloff
5,810,361 A 9/1998 Kadlic
5,823,873 A 10/1998 Moody
5,839,730 A 11/1998 Pike
5,839,731 A 11/1998 Feola
5,842,698 A 12/1998 Brown
5,845,906 A 12/1998 Wirth
5,851,147 A 12/1998 Stupak et al.
5,851,148 A 12/1998 Brune et al.
5,868,618 A 2/1999 Netley et al.
5,868,619 A 2/1999 Wood et al.
5,882,259 A 3/1999 Holmes, Jr. et al.
5,882,260 A 3/1999 Marks et al.
5,913,726 A * 6/1999 Jones et al. ..... 463/13

FOREIGN PATENT DOCUMENTS

AU 628044 4/1989

| | | | |
|---|---|---|---|
| CA | 1334983 | | 3/1995 |
| CA | 1335381 | | 4/1995 |
| DE | 2830216 | | 1/1980 |
| DE | 3003376 | | 8/1981 |
| DE | 68909992 | | 4/1989 |
| DO | 4792 | | 6/1991 |
| DO | 4793 | | 6/1991 |
| DO | 4825 | | 3/1993 |
| DO | 4999 | | 9/1993 |
| EP | 03384029 | | 4/1989 |
| GB | 2083936 | | 3/1982 |
| GB | 2097570 | | 11/1982 |
| GB | 2177610 | A | 7/1985 |
| GB | 2169736 | | 7/1986 |
| GB | 2184029 | | 6/1987 |
| IT | 0338644 | | 4/1989 |
| JP | 4-371186 | | 12/1992 |
| JP | 135187 | | 6/1998 |
| WO | 93/10869 | | 6/1993 |
| WO | 94/15684 | | 7/1994 |
| WO | 95/21665 | | 8/1995 |
| WO | 97/13562 | | 4/1997 |
| WO | 92/20417 | | 11/1997 |

OTHER PUBLICATIONS

"Blackjack: Progressive Bonuses", Winning Gamer, Pi Yee Press, 1985.*

"Over/Under 13 Blackjack", Gaming Concepts, Inc. 1988.*

"Big Field", Declaration Under 37 CFR 1.132, Jim Kilby, May 1995.*

Winning Gamer, Issue #5, Feb. 1985, Pi Yee Press, La Jolla, CA.

Winning Gamer, Issue #6, Mar. 1985, Pi Yee Press, La Jolla, CA.

Winning Gamer, Issue #15, Dec. 1985, Pi Yee Press, La Jolla, CA.

Winning Gamer, Issue #19, Apr. 1986, Pi Yee Press, La Jolla, CA.

Winning Gamer, Issue #20, May 1986, Pi Yee Press, La Jolla, CA.

Winning Gamer, Issue #21, Jun. 1986, Pi Ye Press, La Jolla, CA.

Affidavit of John F. Acres, Oct. 4, 1993.

Affidavit of William Randal Adams, Oct. 4, 1993.

Affadavit of Derell M. Johns, Nov. 9, 1993.

Affidavit of Terry Oliver, Nov. 22, 1993.

Affidavit of Nick Edward Greenwood, Nov. 23, 1993.

Affidavit of Michael Spencer Stone, Nov. 23, 1993.

Scarne, Scarne's Encyclopedia of Games, Harper & Row, N.Y. Copy 1973, pp. 381, 383 and title pages.

Scarne, Scarne's Encyclopedia of Games, Harper & Row, N.Y., Copyright 1973, pp. 33–41 and title pages.

Scarne, Scarne's New Complete Guide To Gambling, Simon & Schuster, N.Y., Copyright 1961, pp. 440–445.

Scarne, Scarne's Encyclopedia of Games, Harper & Row, N.Y., Copyright 1983, pp. 299–305; 383 and title pages.

W.E. Gibson, Hoyle's Modern Encyclopedia of Card Games, pp. 218–219, 369–370, (1974).

Casino Player, vol. IV, No. 12, Aug. 1993, "My Biggest Slot Jackpot", Stanford Wong.

Gaming Concepts, Inc. "Over/Under 13 Blackjack" brochure, 1988.

Casino Gaming, Sep. 1988, "Auruba Deals a New Game: Caribbean Stud Poker", pp. 12–13.

Casino Journal, vol. 8, No. 12, Dec. 1992, "Working Within the Systems: IGT's linked progressive programs take leap to the tables", pp. 10–15, 40, 41.

Casino Journal, vol. 8, No. 6, Jun. 1993, "So You Want to be a Gambler", pp. 1–5.

Las Vegas Sun "A New Game Introduced" Mar. 5, 1982.

Las Vegas Sportsbook "Sklansky Invents New Casino Games" Mar. 19–25, 1982 Vegas World "Casino Poker".

Sklansky "Casino Poker" rule card, TX899,489, copyrighted Apr. 4, 1982.

Bob Stupak's Vegas World "Casino Poker Rules".

Information Disclosure Statement, Apr. 7, 1988, describing "Sklansky's Casino Poker" and "Video Poker".

Coin Hopper Model CH–500 and Model No. CH–750–U1 literature Asahi Seiko.

Jan. 26, 1993 Statement of Grounds and Particulars, by John Huxley Ltd., in opposition to Australian Petition for Patent Application No. 628044.

State of Jew Jersey Casino Control Commission PRN 217205 Civil Action, IGT's Second Amended Petition for Authorization for the Implementation of the Game of Progressive 21, filed sometime after Aug. 4, 1992.

Review Journal, "Gamblers Take Chance at Million Dollar Payoff" by D. J. boyer.

Winning Gamer, Issue #17, Feb. 1986, Pi Yee Press, La Jolla, CA.

Scarne, Scarne's Encyclopedia of Games, "Hold'Em", Harper & Row Publishers Copyright 1973, pp. 14–18, 26.

Abercrobe & Fitch, Play Hours, 1960 p. 11, Blackjack Towel.

Scarne, Scarne's Encyclopedia of Games, copyright date unknown, p. 288.

Jim Kilby's Declaration under 37 C.F.R. 1.132.

TXU 184,603, Mar. 30, 1985.

Scarne, Scarne's Guide to Modern Poker, copyright unknown, pp. 40, 60–61.

Request for Reexamination, U.S. Patent No. 4,861,041, issued Aug. 29, 1989; date of service, Jun. 20, 1995.

Request for Reexamination, U.S. Patent U.S. Patent No. 4,861,041, issued Aug. 29, 1989; date of service, Sep. 2, 1993.

Request for Reexamination, U.S. Patent No. 5,288,077, issued Feb. 22, 1994; date of service, May 26, 1995.

Request for Reexamination, U.S. Patent No. 5,364, 105, issued Nov. 15, 1994; date of service, May 29, 1995.

Asahi Seiko Catalog No. AV89C, Aug. 20, 1989; pp. 44, 51 and Photograph "A".

Scarnes, Scarne's Encyclopedia of Games, Copyright 1973, pp. 11, 31, 440–445.

Declaration of I. Nelson Rose, dated Jan. 26, 1989.

Declaration of Don Clark, Date Feb. 2, 1989.

Affidavit of Dennis Robie, dated Jan. 27, 1989.

Declaration of Mark A. Sincox, dated Feb. 7, 1989.

Declaration of John Edward Roethel, dated Feb. 7, 1989.

Commerce Casino Brochure Re Wisted California Blackjack.

D&D Gaming Patent, Inc. v. Rio Properties, Inc. et al.: Case No.: CV–S–93–835–LDG–RLH; Defendants Request for Reexamination, U.S. Patent No. 5,377,973, issue Jan. 3, 1995.

PCT Written Opinion US 96/16409.

Royal Match 21 "Win Your Fortune" brochure, copyrighted 1991.

Fortune Card 21 "Win Your Fortune" brochure, copyrighted 1991.
Winning Gamer, Issue #17, Feb. 1986.
Over/Under 13 Blackjack brochure.
Official Rules of Card Games, edited by A.H. Morehead, pp. 78–93, copyright date 1968.
Specific Model Information Form FO–652–216.
Table Layout for "Casino Poker" Feb. 15, 1992.
TX 2 568 066 for Over/Under 13.
Supplement to Request for Reexam filed Under 1.510 served Mar. 25, 1998.

* cited by examiner

METHOD FOR PROGRESSIVE JACKPOT GAMING

CROSS REFERENCE TO RELATED APPLICATION(S)

This application is a continuation of U.S. Ser. No. 09/583,109 filed May 24, 2000 U.S. Pat. No. 6,234,895, which is a continuation of U.S. Ser. No. 09/436,772 filed Nov. 5, 1999, which is a continuation of U.S. Ser. No. 09/266,613 filed Mar. 9, 1999, now U.S. Pat. No. 6,045,130, which is a continuation of U.S. Ser. No. 08/967,850 filed Nov. 12, 1997, now U.S. Pat. No. 5,913,726, which is a continuation of U.S. Ser. No. 08/811,364 filed Mar. 6, 1997, now U.S. Pat. No. 5,795,225, which is a continuation of U.S. Ser. No. 08/334,661 filed Nov. 4, 1994, now U.S. Pat. No. 5,584,788, which is a divisional of U.S. Ser. No. 08/040,925 filed Mar. 31, 1993, now U.S. Pat. No. 5,364,104.

BACKGROUND OF THE INVENTION

This invention relates generally to casino or cardroom gaming involving a progressive jackpot. More particularly, it relates to a progressive jackpot that is available to be played by participants in various casino or cardroom table games.

It has become common practice in gaming establishments to provide a progressive jackpot component in connection with electronic or mechanical gaming devices, such as slot machines, video poker machines or keno machines. Typically a plurality or "bank" of machines are electronically interconnected to a common progressive jackpot meter. As gaming tokens are fed into each machine, the amount shown on the jackpot meter progresses incrementally until some lucky player lines up the winning combination, such as three or four 7's on the same row of a slot machine. In video poker, a Royal Flush normally wins the jackpot, although in some variations, a player must achieve a Royal Flush in an exact order, such as A-K-Q-J-10 from left to right, or in a particular suit, such as Spades. In video keno, a player typically must match 15 out of 15 numbers to win the progressive jackpot.

It is an object of the present invention to provide a progressive jackpot component to typical casino or cardroom table games such as poker or Twenty-One.

It is a feature of the present invention to have each participant in the progressive jackpot component win all or part of the amount shown on the progressive jackpot meter if the participant achieves a particular predetermined playing hand.

It is an advantage of the present invention that when the progressive jackpot component is added to typical table games such as poker or Twenty-One that the players will enjoy these games more and that the amount of play will increase.

It is a further object of the present invention to provide apparatus useful in providing the progressive jackpot component to casino or cardroom table games such as poker or Twenty-One.

It is a further feature of the present invention to have a progressive jackpot meter electronically interconnected to one or more gaming tables to allow each player at his playing location to participate in the progressive jackpot component by wagering a gaming token which automatically activates an indicator showing the player's participation and also automatically increments the progressive jackpot meter.

It is an advantage of the present invention that the apparatus makes it easy for each player to participate in the progressive jackpot component of the game.

BRIEF SUMMARY OF THE INVENTION

The method of the present invention generally involves a typical casino or cardroom game modified to include a progressive jackpot component. During the play of a Twenty-One game, for example, in addition to this normal wager, a player will have the option of making an additional wager that becomes part of, and makes the player eligible to win, the progressive jackpot. If the player's Twenty-One hand comprises a particular, predetermined arrangement of cards, the player will win all, or part of, the amount showing on the progressive jackpot. This progressive jackpot feature is also adaptable to any other casino or cardroom game such as Draw Poker, Stud Poker, Lo-Ball Poker or Caribbean Stud™ Poker.

The apparatus used to practice the present invention comprises a gaming table, such as those used for Twenty-One or poker, modified with the addition of a coin acceptor that is electronically connected to a progressive jackpot meter. When a player drops a coin into the coin acceptor, a light is activated at the player's location indicating that he is participating in the progressive jackpot component of the game during that hand. AT the same time, a signal from the coin acceptor is sent to the progressive meter to increment the amount shown on the progressive meter. At the conclusion of the play of each hand, the coin acceptor is reset for the next hand. When a player wins all or part of the progressive jackpot, the amount showing on the progressive jackpot meter is reduced by the amount won by the player. Any number of gaming tables can be connected to a single progressive jackpot meter.

DETAILED DESCRIPTION OF THE PREFERRED EMBODIMENT

Figure 1:
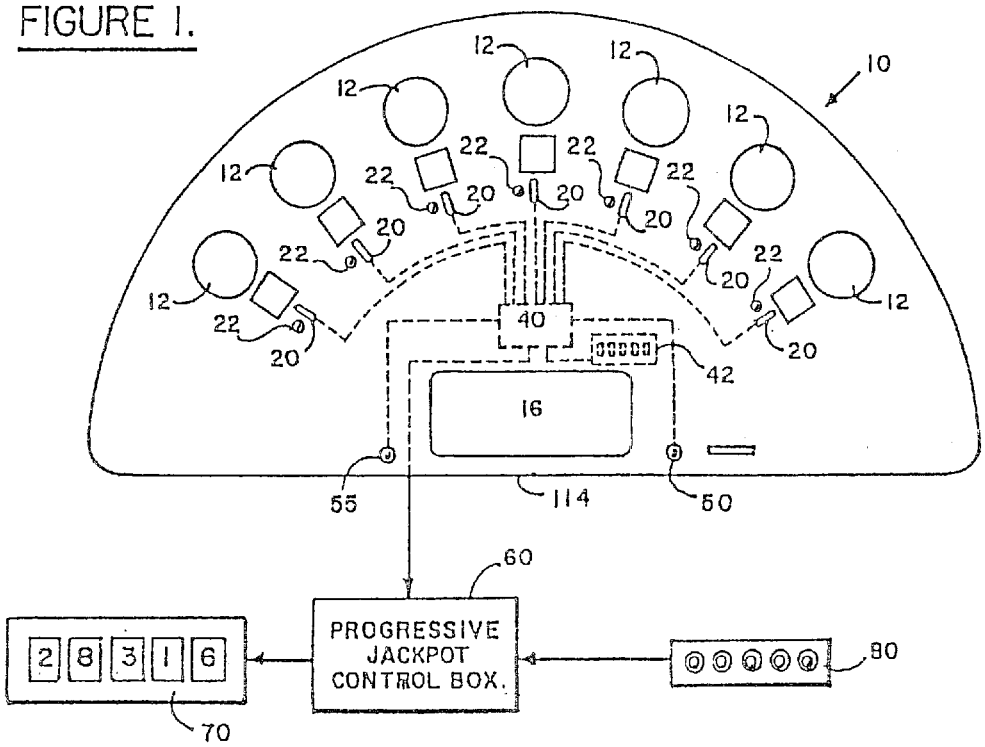
FIG. 1 is shows the apparatus of the present invention using a casino gaming table with coin acceptors at each playing location electronically connected to a progressive jackpot meter.

As shown in FIG. 1, a casino gaming table 10 is provided having a plurality of playing locations 12 for players participating in the game being conducted, e.g., Twenty-One. A dealer is positioned at the dealer's location 14 adjacent a chip rack 16. Adjacent to each player location 12 is a coin acceptor 20. Each coin acceptor 20 is electronically connected to a main control board 40 to which is connected a number of odometer-type counters 42 corresponding to the number of playing locations 12 provided on the gaming table 10. As shown in FIG. 1, seven playing locations 12 are preferably provided, although the number of playing locations can be more or less than seven. A reset switch 50 is located adjacent the dealer's location 14 and is electronically connected to the main control board 40 and provides a means whereby the dealer can reset the coin acceptors 20 prior to the beginning of the play of each hand. A lockout switch 55, is also provided adjacent to the dealer's location 14 which is activated by the dealer to prevent later wagering as will be more fully explained herein.

A main control board 40 is electronically connected to a progressive jackpot control box 60 which receives the signals from each coin acceptor 20 and in response to those signals increments the progressive jackpot meter 70, as will be more fully explained herein. Also electronically connected to the progressive control box 60 is the jackpot reset control 80 which provides means for resetting the amount shown on the progressive jackpot meter whenever a player wins all, or part of, the amount shown on the progressive jackpot meter 70.

In operation, the present invention operates as follows. A conventional Twenty-One game is conducted on gaming table 10. At the beginning of each hand, each player, in addition to making his usual wager for the play of the Twenty-One hand, may also make an additional wager to be eligible to participate in the progressive jackpot component of the game during that hand. To do so, a player places a gaming token into the coin acceptor 20 associated with that player's particular playing location 12. As will be more fully explained herein, the coin acceptor 20 "recognizes" that a gaming token has been placed therein and an indicator signal 22, preferably a light, adjacent to the coin acceptor 20 is activated showing that that particular player is participating in the progressive jackpot component of the game during the play of that hand.

Besides activating the indicator signal 22, the coin acceptor 20 also sends an electronic signal to the main control board 40. This signal is sent by the main control board 40 to the odometer-type counter 42 corresponding to the particular playing location 12 to keep a sequential count of the number of gaming tokens that are placed in the particular coin acceptor 20.

The main control board 40 also activates the progressive jackpot control box 60 which in turn controls the progressive jackpot meter 70. Each gaming token placed in a coin acceptor 20 results in the amount shown on the progressive jackpot meter being increased by a predetermined amount. If, for example, each gaming token has value of one dollar, then the amount shown on the progressive jackpot meter would be increased by any amount up to one dollar for each gaming token placed into a coin acceptor 20. In the preferred embodiment of the present invention, the progressive jackpot would be increased between 93% and 97% of the amount of each gaming token being wagered, the balance representing the house's share of the amount wagered for providing the progressive jackpot component of the game.

When each player has had a reasonable opportunity to make a progressive jackpot wager, the dealer activates lockout switch 55 which deactivates each coin acceptor 20. Any tokens placed in a coin acceptor 20 after lockout switch 55 is activated will not register. This prevents late wagering after the cards are dealt.

The amount shown on the progressive jackpot meter will continue to increase for each gaming token wagered until a player achieves a winning hand. Preselected winning hands earn a player all or part of the amount shown on the progressive jackpot meter. In a preferred embodiment, the preselected winning hands and payoff amounts in Twenty-One game are as follows:

| Winning Hand | Amount of Jackpot |
|---|---|
| Four 5's and an Ace | 100% |
| Ace, two, three, four, five and six | 4% |
| Six, seven and eight of same suit | 100 tokens |
| Three 7's | 50 tokens |

The invention is not limited to these particular combinations of winning hands or payoffs; other winning hand combinations or payoff amounts can be utilized.

When a player achieves a winning hand, the jackpot reset control 80 is manually activated by pushing a button that corresponds to the type of hand that the player achieved. The amount won by the player is thus electronically deducted from the amount showing on the progressive jackpot meter.

When a particular hand is completed at gaming table 101, the dealer presses the reset switch 50, which deactivates the indicator signal 22. Lockout switch 55 is also manually deactivated by the dealer. The coin acceptor 20 is thus readied to receive another gaming token for the next hand.

The progressive jackpot component of the present invention can also be used in connection with other types of casino games, e.g., Caribbean Stud™ Poker, which is the subject matter of U.S. patent application Ser. No. 102,374 filed Apr. 18, 1988, which is incorporated herein by reference thereto. Caribbean Stud™ Poker is a modification of conventional five-card stud poker. Each player makes an ante and a dealer deals five cards to each player and to himself. The player's cards are dealt face down and the dealer's cards are dealt four cards face down and one card face up. Each player views his hand and then decides whether to continue to play by making an additional bet or to fold or drop, in which case he loses his ante. The dealer then reveals his entire hand; if the dealer's hand does not have a poker value of at least Ace-King, then the dealer is not permitted to continue to play. In that case, the dealer pays even money on the remaining players' antes, and returns their bets to them. If the dealer's hand has a poker value of Ace-King or better, the dealer compares his hand to each player's hand, paying or collecting the bets as appropriate. The dealer also pays odds of more than even money on each winning player's hand of two pair or better according to a bonus payment schedule. This game can be played using the gaming table shown in FIG. 1. Each player makes a progressive jackpot wager by placing a gaming token in the coin acceptor 20 which makes that player eligible to participate in the progressive jackpot amount shown on the meter 70. The winning hands and amounts for Caribbean Stud™ Poker are preferably as follows:

| Hand | Amount |
|---|---|
| Royal Flush | 100% |
| Straight Flush | 10% |
| Four of a Kind | 1% |
| Full House | 50 tokens |
| Flush | 25 tokens |

Again the invention is not limited to these particular combinations of hands or payoff amounts; other hand combinations or payoff amounts can be utilized.

Figure 2:
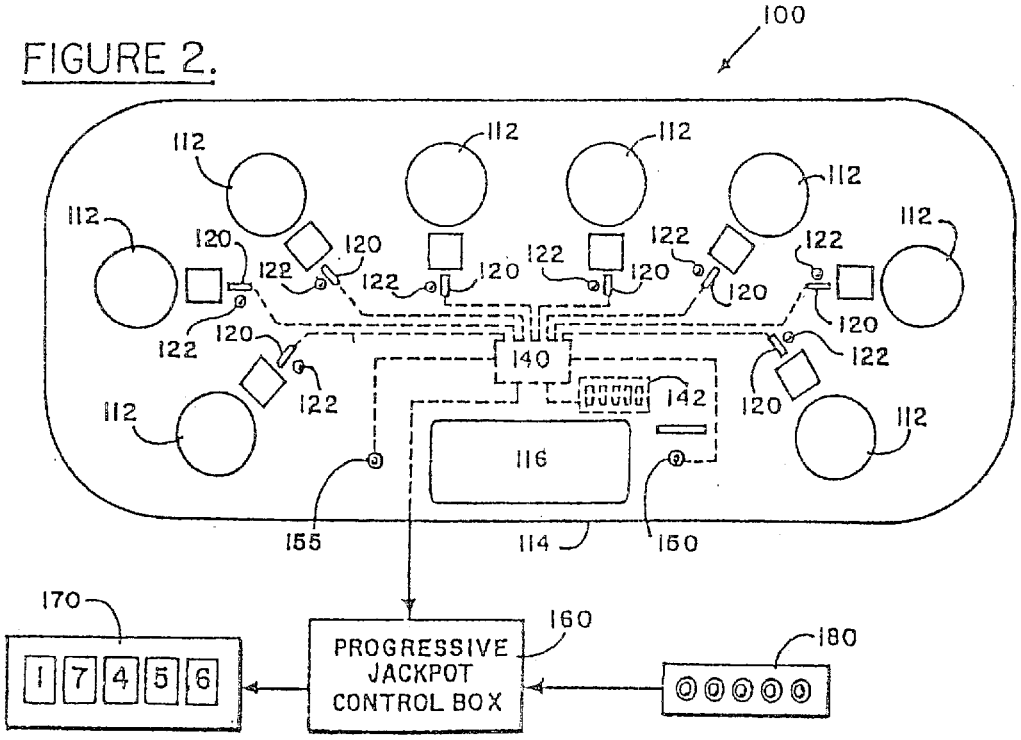
FIG. 2 shows an alternate embodiment of the present invention using a cardroom gaming table with coin acceptors at each playing location electronically connected to a progressive jackpot meter.

The invention can also be adapted to other casino or cardroom poker games such as Stud Poker, Draw Power or Lo-Ball Poker. The gaming table 100 used to play each of these games is modified as shown in FIG. 2 by the addition of coin acceptors 120 and indicator signals 122 at each player's location 112. The electronics is the same as that shown in FIG. 1 and includes a main control board 140, an odometer-type counter 142, a progressive jackpot control box 160, a progressive jackpot meter 170 and a jackpot reset control 180. A reset switch 150 and a lockout switch 155 are located adjacent the dealer's location 114 next to the chip rack 116.

The progressive jackpot meter 170 is incrementally increased in the same manner as that described in connection with FIG. 1 by each player placing a gaming token in the coin acceptor 120.

The winning hands and payoff amounts are preselected as appropriate for the type of game being played. In the preferred embodiment, the winning hands and payoff amounts are as follows:

| Hand | Amount |
|---|---|
| I. Five Card Draw Poker | |
| Royal Flush | 100% |
| Straight Flush | 10% |
| Four of a Kind | 100 tokens |
| Full House | 25 tokens |
| II. Five Card Stud Poker | |
| Royal Flush | 100% |
| Straight Flush | 10% |
| Four of a Kind | 100 tokens |
| Full House | 25 tokens |
| III. Seven Card Stud Poker | |
| Royal Flush | 100% |
| Straight Flush | 10% |
| Four of a Kind | 100 tokens |
| Full House | 25 tokens |
| IV. Lo-Ball Poker | |
| 5-4-3-2-Ace | 100% |
| 6-4-3-2-Ace | 5% |
| 6-5-3-2-Ace | 100 tokens |
| 7-4-3-2-Ace | 25 tokens |

These winning hands and payoff amounts are merely preferred embodiments and the invention may be practiced using any appropriate combination of winning hands and payoff amounts.

As an alternative embodiment, progressive jackpot component of the game may be utilized as a consolation payoff for a player who otherwise loses during the play of the regular game. For example, assume the regular game being played is Five Card Stud. Players A and B re both eligible for the progressive jackpot amount because each has placed a gaming token in the coin acceptor prior to the beginning of the play of the hand. Player A holds a hand having Four of a Kind. Player B holds a Full House. Because Player A's hand is higher according to the customary poker hand ranking priority, Player A wins the pot wagered on the Five Card Stud game. As a consolation, however, Player B receives a payoff amount from the progressive jackpot for his Full House, e.g., 25 tokens. Player A does not receive a payoff from the progressive jackpot because he already has won the pot from the regular Five Card Stud game. Thus, under this alternative embodiment, a player only receives a payoff from the progressive jackpot if the player both has a hand of the preselected type and loses to a higher hand in the game being played.

Another modification would have the two players sharing in the progressive jackpot amount; the player with the preselected type of hand receiving a percentage of the progressive jackpot amount and the player with the higher poker hand receiving the rest of the progressive jackpot amount. With reference to the example above, Player B would receive 80% of the progressive jackpot amount for a Full House and Player A would receive 20% of the progressive jackpot amount for a Full House.

Figure 3:
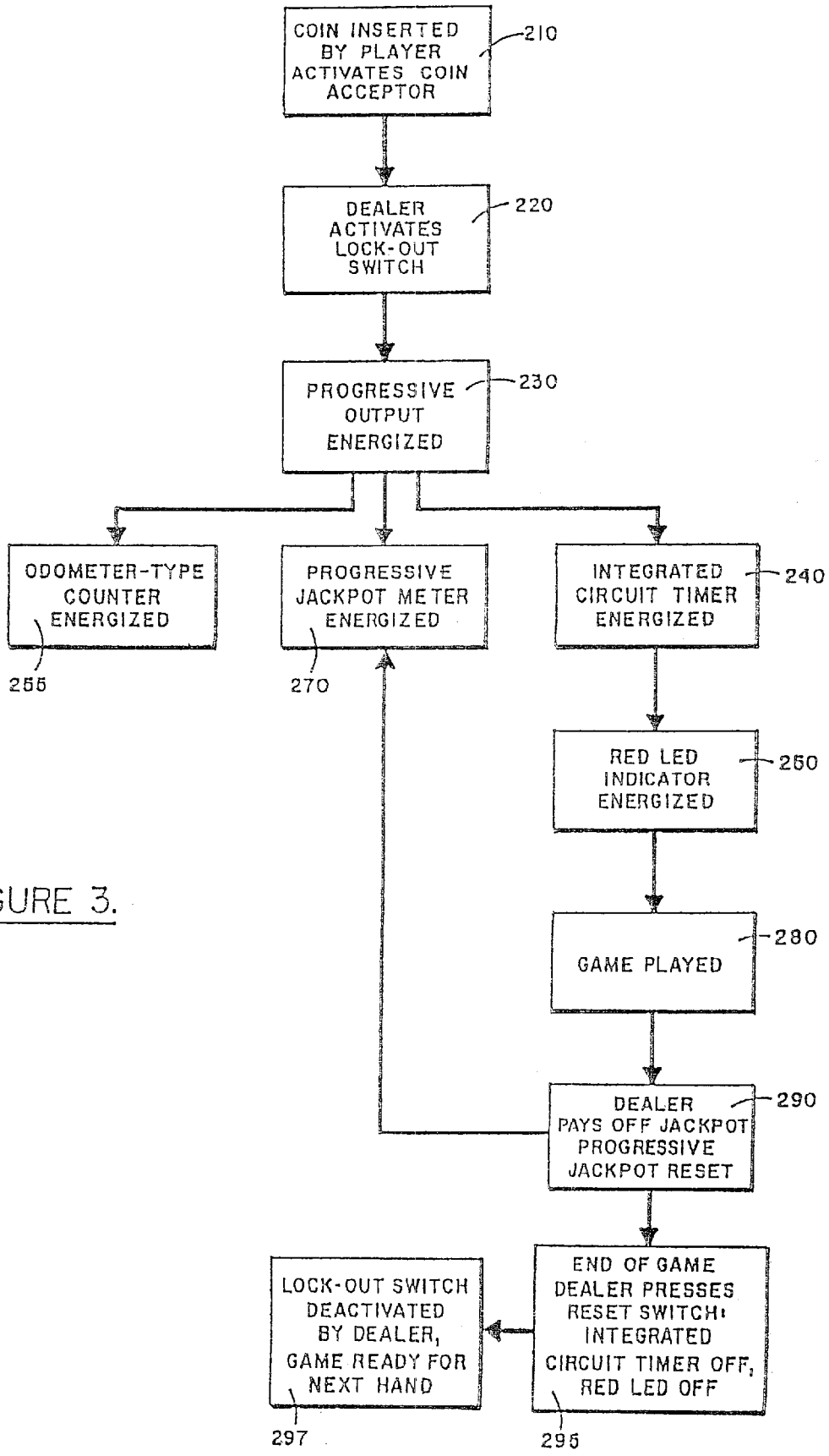
FIG. 3 shows a block diagram of the operation of the present invention.

FIG. 3 shows in block diagram form the operation of the present invention. Each playing location has a coin acceptor 210 into which a player places a gaming token in order to be eligible for the progressive jackpot amount. When all players have had sufficient time to decide whether to participate in the progressive jackpot for that hand the dealer activates the lockout switch 220 which prevents late wagers. Each gaming token placed in a coin acceptor 210 energizes the progressive output control 230 which in turn activates three separate devices. An integrated circuit timer is energized which causes an indicator light 250 to be illuminated at the location on the coin acceptor in front of the player. This gives a visual indication to the dealer that that player is participating in the progressive jackpot during the play of that hand.

The signal from the progressive jackpot control 230 also activates an odometer-type counter 255 which increments by one unit for each gaming token wagered through the coin acceptor. This allows the gaming establishment to keep an accurate account of the number of wagers made on the progressive jackpot.

The third signal from the progressive jackpot control 230 goes directly to the progressive jackpot meter 270. The progressive jackpot meter 270 shows the total amount available to be won by a player who obtains one of the preselected winning hands. The amount of the progressive jackpot meter 270 automatically increased a predetermined amount for each gaming token placed in the coin acceptor. The progressive jackpot meter 270 is programmed to increase a specified percentage of the amount wagered in the coin acceptor 210. In the preferred embodiment, the progressive jackpot meter will be increased between about 93% to 97% of the amount wagered in the coin acceptor 210.

The dealer then deals the cards to each player and the hand is played 280. If a player has a preselected winning hand, the player is paid the amount corresponding to the type of winning hand that the player has. The jackpot reset control 290 is manually activated which results in the amount of payoff being automatically deducted from the amount displayed on the progressive jackpot meter 270.

After the winning players have been paid, the dealer activates the reset switch 295 which both turns off the integrated circuit timer 240 and turns off the indicator light 250 and the dealer deactivates the lockout switch 297 thereby activating the coin acceptor 210 for the next hand.

Figure 4:
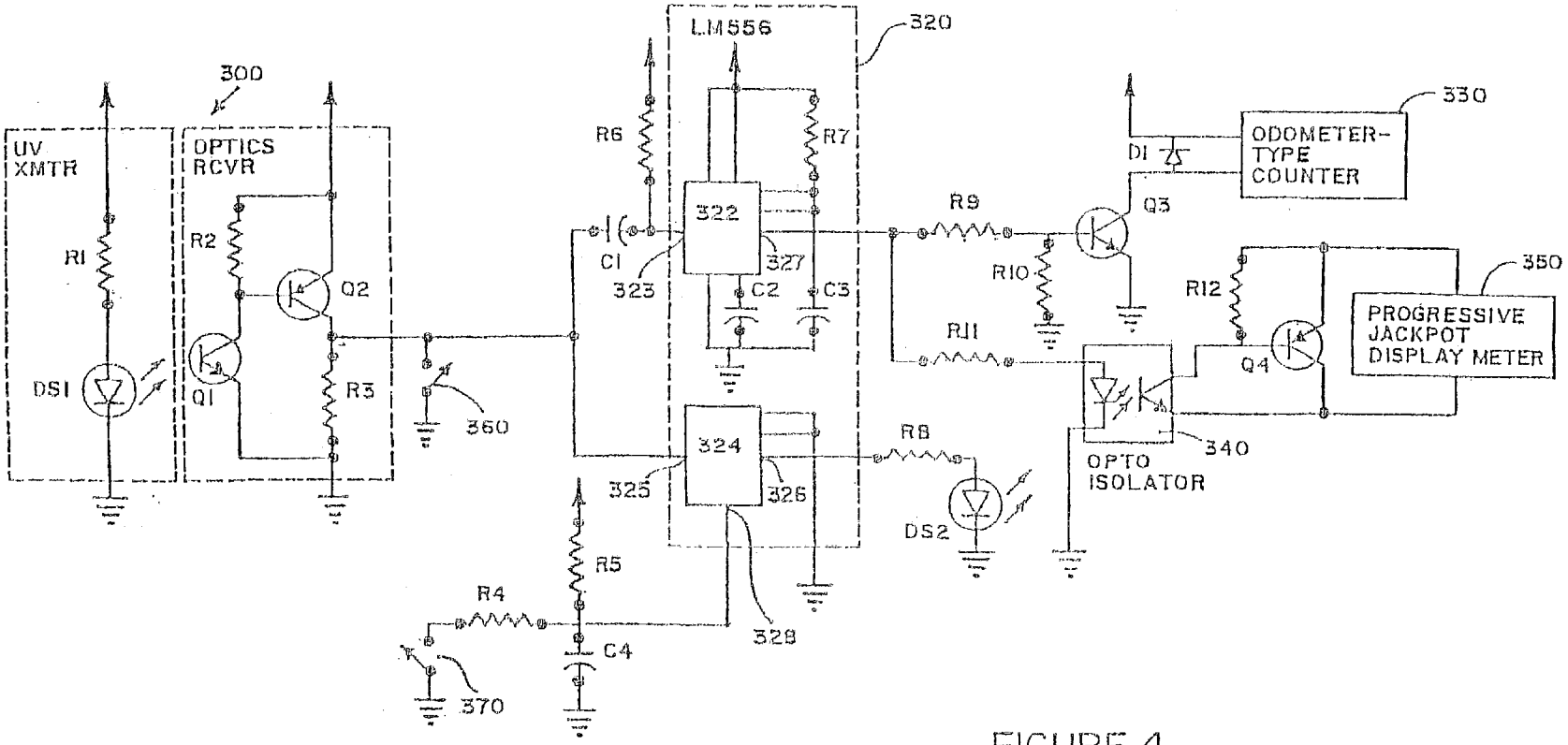
FIG. 4 shows a schematic diagram of the electronic circuitry of the present invention.
Figure 5:
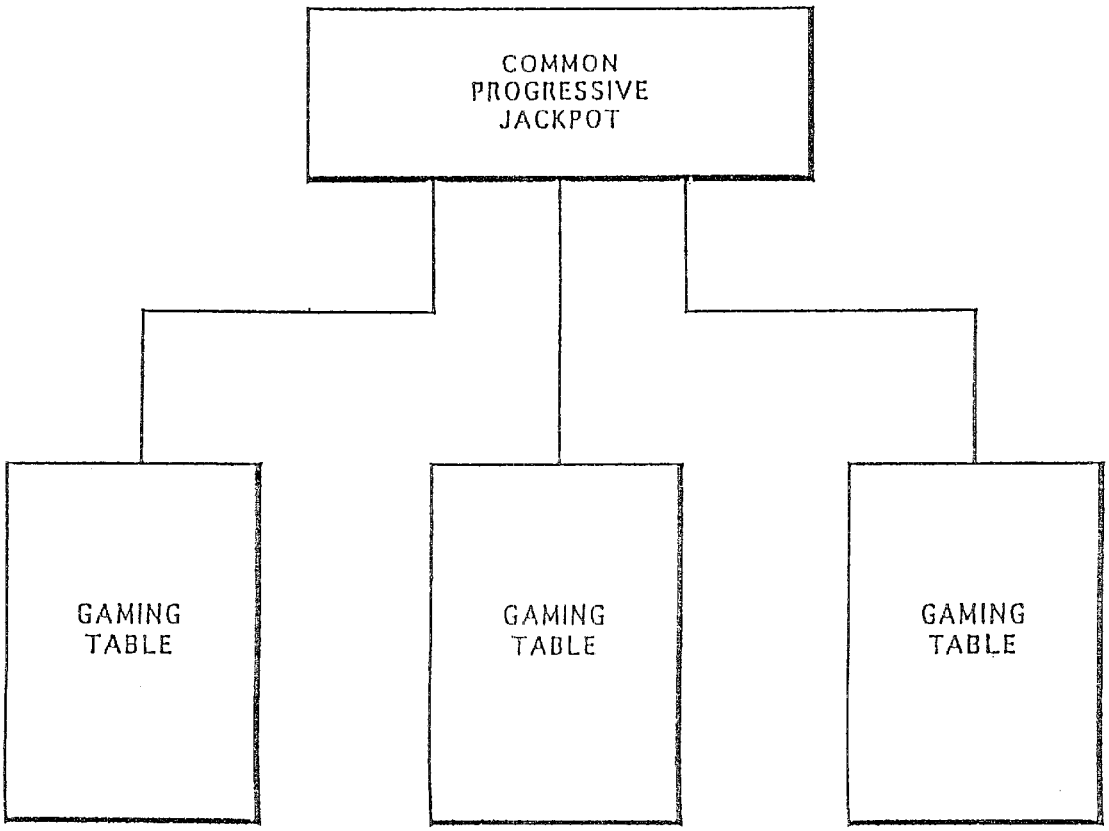
FIG. 5 shows a block diagram of a plurality of gaming tables connected to a single progressive jackpot meter.

FIG. 4 in schematic form depicts the electronic circuitry to operate the apparatus of the present invention. The coin acceptor circuitry 300 is activated when a gaming token is dropped into the slot on the gaming table where the coin acceptor is mounted. The gaming token passes between an ultraviolet transmitter DS1 and an optic receiver Q1 (Model #MRD 300 transistor). This causes a pulse to be passed from the collector of Q1 to the base of receiver Q2. Q2 is a Model #2N3906 transistor and acts as an emitter follower and sends a pulse which is received by the integrated circuit 322,324 of the main control board 320. The integrated circuit 322, 324 is a Model #LM-556 Timer. The pulse from Q2 is received at pin 325 of the lower portion 324 of the integrated circuit and this pulse causes pin 326 of the lower portion 324 to go high and turn on diode DS2 (a Model P367 diode). This diode DS2 is the indicator light 22 shown in FIG. 1 and this indicator light 22 stays on until the play of the hand is finished.

The pulse from Q2 also is received by pin 323 on the upper portion 322 of the integrated circuit and this pulse creates a pulse at pin 327 of the upper portion 322 which causes transistor Q3 (a Model #T1P120 transistor) to turn on, then off for the duration of the pulse created at pin 327. The turning on and off of transistor Q3 causes the odometer-type counter 42 shown in FIG. 1 to increment one digit. The odometer-type counter 330 is a six-digit non-resetable electronic 12VDC counter, WICO Model #31-443400.

The pulse created at pin 327 of the upper portion 322 of the integrated circuit also goes to the opto isolator 340 (which is a Model #H11A16E Opto Isolator). The opto isolator 340 passes this pulse to the base of transistor Q4 (a Model #2N3906 transistor) thereby turning on transistor Q4 for the duration of the pulse. When transistor Q4 is turned on, the pulse is passed to the progressive jackpot display meter 350 where the amount shown on the display meter 350 is increased by a predetermined percentage of the value of the gaming token placed in the coin acceptor 300. The progressive jackpot display meter 350 can typically be a Game Technology Model having 3" LED characters on a 44" length single progressive display.

After all bets are made, the dealer manually presses a lockout switch 360 which will clamp the output of the transistor Q2 at a low level which ensures that there can be no late wages made through the coin acceptor 300. Once the output of the transistor Q2 is clamped at a low level, a gaming token placed in the coin acceptor 300 will not cause a pulse to flow through the rest of the circuitry.

The game is then played and once the game is completed, the dealer will manually press the reset switch 370 which creates a reset pulse that activates pin 320 which resets the lower portion 324 of the integrated circuit. This resetting causes pin 326 to go low which will extinguish diode DS2 which turns off the indicator light 22 on the gaming table.

The dealer also manually presses the lockout switch 360 to open the circuit and remove the clamp on the emitter of transistor Q2 which allows another hand to be played. The players commence the next hand by placing gaming tokens in the coin acceptor 300 and the process is repeated.

As will be apparent to those skilled in the art, various resistors and capacitors are provided to complete the circuitry. The specifications on the resistors and capacitors shown in FIG. 4 is as follows:

| Registors | Capacitors |
|---|---|
| R1-68 Ohm | C1-.1 ufd/35 v |
| R2-3 Kohm | |
| R3-1 Kohm | C2-.01 ufd/35 v |
| R4-200 Ohm | |
| R5-4.7 Kohm | C3-.2 ufd/35 v |
| R6-10 Kohm | |
| R7-1 Mohm | C4-.1 ufd/35 v |
| R8-240 Ohm | |
| R9-1 Kohm | |
| R10-4.7 Kohm | |
| R11-240 Ohm | |
| R12-1 Kohm | |

While the present invention has been particularly shown and described with reference to the preferred mode as illustrated in the drawing, it will be understood by one skilled in the art that various changes in detail may be effected therein without departing from the spirit and scope of the invention as defined by the claims.

What is claimed is:

1. A method of including a jackpot component as an additional feature in a table game in which a plurality of players may participate, said jackpot component including at least one progressive amount and at least one non-progressive amount, comprising the steps of:

(a) a player making at least one game wager to participate only in the table game;

(b) the player optionally making at least one jackpot wager to participate in the jackpot component, wherein no portion of said at least one jackpot wager contributes toward the play or winnings of said table game;

(c) playing said table game only after the player has made said game wager and decided whether to optionally make said jackpot wager;

(d) determining whether a player who has made said at least one jackpot wager has won according to a predetermined set of rules; and (e) paying to said winning player who has made said at least one jackpot wager at least a portion of said at least one progressive amount.

2. The method of claim 1 wherein said portion of said progressive amount is predetermined.

3. The method of claim 1 wherein said portion of said progressive amount is 100%.

4. The method of claim 1 further comprising the step of visibly displaying said progressive amount on a meter positioned in view of the player.

5. The method of claim 1 wherein any progressive amount that is not won on the first game carries over to the next game.

6. The method of claim 1 wherein said game comprises a card game.

7. The method of claim 6 wherein said card game comprises a casino poker game.

8. The method of claim 7 comprising the additional steps of providing at least one light associated with the player and indicating the making of said at least one jackpot wager by the player by illuminating the at least one light associated with the player making said at least one jackpot wager.

9. The method of claim 6 wherein said card game comprises a casino twenty-one game.

10. The method of claim 9 comprising the additional steps of providing at least one light associated with the player and indicating the making of said at least one jackpot wager by the player by illuminating the at least one light associated with the player making said at least one jackpot wager.

11. The method of claim 1 wherein said jackpot component includes at least two progressive amounts and at least two non-progressive amounts.

12. The method of claim 1 comprising the additional steps of providing at least one light associated with the player and indicating the making of said at least one jackpot wager by the player by illuminating the at least one light associated with the player making said at least one jackpot wager.

13. The method of claim 1 wherein said jackpot component includes at least two non-progressive amounts each having a value determined as a ratio of at least 100 times the amount of said at least one jackpot wager.

14. A method of including a prize component as an additional feature in a casino game in which a plurality of players may participate, said prize component including a plurality of different prizes, at least one of which is a non-progressive amount having a value determined as a ratio of at least 100 times the amount of said prize wager, comprising the steps of:

(a) a player making at least one game wager to participate only in the casino game;

(b) the player optionally making at least one prize wager to participate in the prize component, wherein no portion of said at least one prize wager contributes toward the play or winnings of said casino game;

(c) playing said casino game only after the player has made said at least one game wager and decided whether to optionally make said at least one prize wager;

(d) determining whether a player who has made said at least one prize wager has won according to a predetermined set of rules; and (e) paying to said winning player who has made said at least one prize wager at least one of said prizes.

15. The method of claim 14 wherein said casino game comprises a poker game.

16. The method of claim 14 comprising the additional steps of providing at least one light associated with the player and indicating the making of said at least one prize wager by the player by illuminating the at least one light associated with the player making said at least one prize wager.

17. A method of including a jackpot component as an additional feature in a table card game in which a plurality of players may participate, said jackpot component including at least one progressive jackpot amount, comprising the steps of:

(a) establishing at least one rule by which a player may win said at least one progressive jackpot amount;

(b) affording a player an opportunity to make at least one game wager to participate only in the table card game;

(c) affording the player an opportunity to make at least one jackpot wager to participate in the jackpot component, wherein no portion of said at least one jackpot wager contributes to the play or winnings of said table card game, with steps (a)–(c) performed in any sequence;

(d) after steps (a)–(c), providing a plurality of cards to each player who has made said at least one game wager;

(e) after step (d), determining whether any player who has made said at least one jackpot wager has won according to said at least one rule;

(f) after step (d), settling any said at least one game wager made by any players; and (g) after step (e), settling any said at least one jackpot wagers made by any players, with steps (f) and (g) performed in any sequence.

18. The method of claim 17 wherein said jackpot component includes at least one progressive amount and at least two non-progressive amounts, wherein said establishing step establishes at least one set of rules by which a player may win said at least one progressive amount and said at least two non-progressive amounts, and wherein said determining step determines whether any player who has made said at least one jackpot wager has won according to said at least one set of rules.

19. The method of claim 18 wherein said table card game comprises a poker game.

20. The method of claim 18 wherein said table card game consists essentially of a poker game.

21. The method of claim 18 wherein said table card game consists essentially of a casino poker game.

22. The method of claim 18 wherein said table card game comprises a twenty-one game.

23. The method of claim 18 wherein said table card game consists essentially of a twenty-one game.

24. The method of claim 18 wherein said table card game consists essentially of a casino twenty-one game.

25. The method of claim 18 wherein each of said at least two non-progressive amounts has a value determined as a ratio of at least 100 times the amount of said at least one jackpot wager.

26. The method of claim 17 wherein said table card game comprises a poker game.

27. The method of claim 17 wherein said table card game consists essentially of a poker game.

28. The method of claim 17 wherein said table card game consists essentially of a casino poker game.

29. The method of claim 17 wherein said table card game comprises a twenty-one game.

30. The method of claim 17 wherein said table card game consists essentially of a twenty-one game.

31. The method of claim 17 wherein said table card game consists essentially of a casino twenty-one game.

32. The method of claim 17 wherein said at least one rule includes a determination of whether the plurality of cards provided to the player in step (d) consists of a selected arrangement.

33. The method of claim 32 wherein said table card game comprises a poker game.

34. The method of claim 32 wherein said table card game consists essentially of a poker game.

35. The method of claim 32 wherein said table card game consists essentially of a casino poker game.

36. The method of claim 32 wherein said table card game comprises a twenty-one game.

37. The method of claim 32 wherein said table card game consists essentially of a twenty-one game.

38. The method of claim 32 wherein said table card game consists essentially of a casino twenty-one game.

39. The method of claim 32 comprising the additional steps prior to step (d) of providing at least one light associated with each player position and indicating the making of said at least one jackpot wager by illuminating the at least one light associated with the location of the player making said at least one jackpot wager.

40. The method of claim 17 comprising the additional steps prior to step (d) of providing at least one light associated with the player and indicating the making of said at least one jackpot wager by the player by illuminating the at least one light associated with the player making said at least one jackpot wager.

41. A method of affording each player who participates in a card game in which a plurality of players in different positions may participate an opportunity to win one of a plurality of prizes in addition to any amounts won in connection with the play of said card game, wherein each of said additional prizes corresponds to one of a plurality of winning arrangements of cards selected before the players receive cards, comprising steps of:

(a) affording a player an opportunity to make at least one game wager to participate only in the card game;

(b) affording the player an opportunity to optionally make at least one prize wager in order to be eligible to win at least one of said additional prizes, wherein said at least one prize wager does not contribute to the play or winnings of said card game;

(c) providing at least one light associated with each player position, with steps (a)–(c) performed in any sequence;

(d) after step (b), indicating the making of said at least one prize wager by the player by illuminating the at least one light associated with the position of the player making said at least one prize wager;

(e) after steps (a)–(d), providing cards to each player who has made said at least one game wager; and (f) awarding one of said prizes to a player only if the player has been provided cards comprising at least one of said winning arrangements of cards and only if the player opted to make said at least one prize wager.

42. The method of claim 41 wherein said card game comprises a poker game.

43. The method of claim 41 wherein said card game consists essentially of a casino table poker game.

44. The method of claim 41 wherein said card game comprises twenty-one.

45. The method of claim 41 wherein said card game consists essentially of twenty-one.

46. The method of claim 43 wherein said winning arrangements include a royal flush, a straight flush, and four of a kind.

47. The method of claim 41 wherein said winning arrangements include four cards of the same rank and suit.

48. The method of claim 41 wherein the player is awarded a prize in step (f) only if the player has been provided cards consisting of at least one of said winning arrangements of cards.

49. A method of affording each player who participates in a casino table poker card game in which a plurality of players may participate an opportunity to win one of a plurality of prizes in addition to any amounts won in connection with the play of said casino table poker card game, wherein each of said additional prizes corresponds to one of a plurality of winning arrangements of at least three cards selected before the players receive cards, and wherein the corresponding additional prize for a higher ranked poker hand is of greater value than the corresponding additional prize for a lower ranked poker hand, comprising the steps of:

(a) providing a gaming table including a plurality of player locations at which players receive cards for playing said casino table poker card game;

(b) affording a player an opportunity to make at least one game wager to participate only in the casino table poker card game;

(c) affording the player an opportunity to optionally make at least one prize wager in order to be eligible to win at least one of said additional prizes, wherein said at least one prize wager does not contribute to the play or winnings of said casino table poker card game, with steps (b) and (c) in any sequence;

(d) electronically recognizing the making of said at least one prize wager at each player location;

(e) after steps (a)–(d), providing cards to each player who has made said at least one game wager until the player achieves a hand consisting of at least three cards; and (f) awarding one of said prizes to a player only if the player's hand comprises at least one of said winning arrangements of at least three cards and only if the player opted to make said at least one prize wager.

50. The method of claim 49 wherein said casino table poker game consists essentially of stud poker.

51. The method of claim 49 wherein said winning arrangements of at least three cards include a royal flush, a straight flush, four of a kind, a full house, a flush, and a straight.

52. A method of affording a player who participates in a table card game an opportunity to win one of a plurality of prizes in addition to any amounts won in connection with the play of said game, wherein each of said additional prizes corresponds to one of a plurality of winning arrangements of cards selected before the player receives cards, comprising the steps of:

(a) establishing at least one set of rules by which the player may win at least one of said additional prizes;

(b) affording a player an opportunity to make at least one game wager to participate only in the table card game;

(c) affording the player an opportunity to make at least one prize wager in order to be eligible to win at least one of said additional prizes, wherein no portion of said at least one prize wager contributes to the play or winnings of said table card game, with steps (a)–(c) performed in any sequence;

(d) after steps (a)–(c), providing a plurality of cards to each player who has made said at least one game wager;

(e) after step (d), determining whether any player who has made said at least one prize wager has won according to said at least one set of rules;

(f) after step (d), settling any said at least one game wagers made by any players; and (g) after step (e), settling any said at least one prize wagers made by any players, with steps (f) and (g) performed in any sequence.

53. The method of claim 52 wherein said additional prizes include at least one progressive amount and at least two non-progressive amounts, and wherein said establishing step establishes at least one set of rules by which a player may win said at least one progressive amount and said at least two non-progressive amounts.

54. The method of claim 53 wherein said table card game comprises a poker game.

55. The method of claim 53 wherein said table card game consists essentially of a poker game.

56. The method of claim 53 wherein said table card game consists essentially of a casino stud poker game.

57. The method of claim 53 wherein said table card game comprises a twenty-one game.

58. The method of claim 53 wherein said table card game consists essentially of a twenty-one game.

59. The method of claim 53 wherein said table card game consists essentially of a casino twenty-one game.

60. The method of claim 53 comprising the additional steps prior to step (d) of providing at least one light associated with the player and indicating the making of said at least one prize wager by the player by illuminating the at least one light associated with the player making said at least one prize wager.

61. The method of claim 53 wherein each of said at least two non-progressive amounts has a value determined as a ratio of at least 100 times the amount of said at least one prize wager.

62. The method of claim 52 wherein said table card game comprises a poker game.

63. The method of claim 52 wherein said table card game consists essentially of a poker game.

64. The method of claim 52 wherein said table card game consists essentially of a casino stud poker game.

65. The method of claim 52 wherein said table card game comprises a twenty-one game.

66. The method of claim 52 wherein said table card game consists essentially of a twenty-one game.

67. The method of claim 52 wherein said table card game consists essentially of a casino twenty-one game.

68. The method of claim 52 comprising the additional steps prior to step (d) of providing at least one light associated with the player and indicating the making of said at least one prize wager by the player by illuminating the at least one light associated with the player making said at least one prize wager.

69. The method of including a jackpot component as an additional feature in a live casino table card game in which a plurality of players may participate, said jackpot component including at least one progressive jackpot amount, comprising the steps of:

(a) establishing at least one rule by which a player may win said at least one progressive jackpot amount;

(b) affording a player an opportunity to make at least one game wager to participate only in the live casino table card game;

(c) affording the player an opportunity to make at least one jackpot wager in order to be eligible to win said at least one progressive jackpot amount, wherein no portion of said at least one jackpot wager contributes to the play or winnings of said live casino table card game, with steps (a)–(c) performed in any sequence;

(d) after steps (a)–(c), providing a plurality of cards to each player who has made said at least one game wager;

(e) after step (d), determining whether any player who has made said at least one jackpot wager has won according to said at least one rule;

(f) after step (d), settling any said at least one game wagers made by any players; and (g) after step (e), settling any said at least one jackpot wagers made by any players, with steps (f) and (g) performed in any sequence.

70. The method of claim 69 wherein said jackpot component includes at least one progressive amount and at least two non-progressive amounts, wherein said establishing step establishes at least one set of rules by which a player may win said at least one progressive amount and said at least two non-progressive amounts, and wherein said determining step determines whether any player who has made said at least one jackpot wager has won according to said at least one set of rules.

71. The method of claim 70 comprising the additional steps prior to step (d) of providing at least one light associated with each player and indicating the making of said at least one jackpot wager by a player by illuminating the at least one light associated with the player making said at least one jackpot wager.

72. The method of claim 70 wherein each of said at least two non-progressive amounts has a value determined as a ratio of at least 100 times the amount of said at least one jackpot wager.

73. The method of claim 69 wherein said table card game comprises a poker game.

74. The method of claim 69 wherein said table card game consists essentially of a poker game.

75. The method of claim 69 wherein said table card game comprises a Twenty-One game.

76. The method of claim 69 wherein said table card game consists essentially of a Twenty-One game.

77. The method of claim 69 comprising the additional steps prior to step (d) of providing at least one light associated with each player and indicating the making of said at least one jackpot wager by a player by illuminating the at least one light associated with the player making said at least one jackpot wager.

78. The method of claim 69 comprising the additional step after step (c) of increasing said at least one progressive jackpot amount in response to the making of said at least one jackpot wager by a player.

79. The method of claim 78 comprising the additional step prior to step (d) of displaying said at least one progressive jackpot amount on at least one sign viewable by said players.

80. The method of claim 79 wherein said table card game consists essentially of a twenty-one game.

81. The method of claim 80 wherein said at least one rule includes whether the cards provided to each player in step (d) consist of a predetermined arrangement of cards.

82. The method of claim 78 wherein said at least one rule includes whether the cards provided to each player in step (d) consist of a predetermined arrangement of cards.

83. The method of claim 69 comprising the additional step prior to step (d) of displaying said at least one progressive jackpot amount on at least one sign viewable by said players.

84. The method of claim 69 wherein said at least one rule includes whether the cards provided to each player in step (d) consist of a predetermined arrangement of cards.

85. A method of including a jackpot component as an additional feature in a twenty-one casino table card game in which a plurality of players may participate, said jackpot component including at least one progressive jackpot amount, comprising the steps of:

(a) providing at least one gaming table including a plurality of player locations at which players receive cards from a human dealer for playing said game;

(b) establishing at least one rule by which a player may win at least a portion of said progressive jackpot amount if the cards dealt to the player during the game consist of a selected arrangement of cards;

(c) affording a player an opportunity to make at least one game wager to participate only in the game;

(d) affording the player an opportunity to make at least one progressive jackpot wager in order to be eligible to win said at least a portion of said jackpot amount, wherein no portion of said at least one jackpot wager contributes to the play or winnings of said game, with steps (b)–(d) performed in any order;

(e) after step (d), increasing said at least one progressive jackpot amount in response to the making of said at least one jackpot wager;

(f) after step (e) and before step (g), displaying said at least one progressive jackpot amount on at least one sign viewable by at least some of said players;

(g) after steps (a)–(d), dealing by a human dealer a plurality of cards to each player who has made said at least one game wager; and (h) after step (g), determining whether any player who has made said at least one jackpot wager has been dealt cards consisting of said selected arrangement of cards and awarding to any such player said at least a portion of said progressive jackpot amount.

86. The method of claim 85 wherein said at least a portion of said progressive jackpot amount is 100% of said progressive jackpot amount.

87. The method of claim 85 wherein a plurality of gaming tables are provided in step (a) and wherein said progressive jackpot amount is displayed on a plurality of signs each located at a corresponding one of said plurality of tables and comprising the additional step of electrically interlinking said plurality of signs such that essentially the same progressive jackpot amount is shown on each sign.

88. The method of claim 86 wherein a plurality of gaming tables are provided in step (a) and wherein said progressive jackpot amount is displayed on a plurality of signs each located at a corresponding one of said plurality of tables and comprising the additional step of electrically interlinking said plurality of signs such that essentially the same progressive jackpot amount is shown on each sign.

* * * * *